US007588207B1

(12) United States Patent
Malkin

(10) Patent No.: US 7,588,207 B1
(45) Date of Patent: Sep. 15, 2009

(54) LEVER-LIFT VERTICAL REEL UNROLLER ASSEMBLY

(75) Inventor: Bruce M. Malkin, Newtown, CT (US)

(73) Assignee: American Products, LLC, Strafford, MO (US)

( * ) Notice: Subject to any disclaimer, the term of this patent is extended or adjusted under 35 U.S.C. 154(b) by 0 days.

(21) Appl. No.: 12/148,694

(22) Filed: Apr. 21, 2008

(51) Int. Cl.
*B65H 75/40* (2006.01)

(52) U.S. Cl. ..... 242/403; 242/533.8; 242/557; 242/559.1

(58) Field of Classification Search ..... 242/403, 242/403.1, 533.8, 557, 533.2, 559.1
See application file for complete search history.

(56) References Cited

U.S. PATENT DOCUMENTS 3,036,790 A * 5/1962 Rheinberger, Jr. ..... 242/559.1
3,321,147 A * 5/1967 Martin ..... 242/559.1
3,325,118 A * 6/1967 Hall ..... 242/393
3,764,031 A * 10/1973 Parsen ..... 414/485
4,088,277 A * 5/1978 Councell ..... 242/559.1
4,253,619 A * 3/1981 Corderoy et al. ..... 242/390.6
4,746,078 A * 5/1988 Setzke ..... 242/559.1
7,464,894 B1 * 12/2008 Himmelberg ..... 242/422.5

* cited by examiner

*Primary Examiner*—Sang Kim
(74) *Attorney, Agent, or Firm*—Lathrop & Gage LLP

(57) ABSTRACT

An assembly for lifting a reel of cable above the floor and supporting it for easy rotation, uses two frame members slidably and pivotably coupled to each other. The first frame has a stop for engaging the periphery of a reel and the second frame or trolley is pivotally and slidably coupled to the first frame via a toggle mechanism. The trolley is pivoted out of the way to a first position to permit a cable reel to engage the stop member of the first frame and then pivoted back to a second position to capture the reel within a cable reel receiving channel in the trolley. The receiving channel has a pivot end near the first frame and a reel-engaging stop member near the opposite end of the channel. The toggle mechanism levers the second frame in sliding relation toward the first frame to capture and lift the reel between the stop members of the first frame and the trolley. The stop members have rotary features and a motor driven assist to rotate one of them for facilitating rotation of the reel.

10 Claims, 5 Drawing Sheets

LEVER-LIFT VERTICAL REEL UNROLLER ASSEMBLY

BACKGROUND OF THE INVENTION

1. Field of the Invention

This invention relates generally to assemblies and apparatus for handling reels of wire, cable and the like, so as to facilitate unrolling [e.g. uncoiling], for use in manufacturing operations.

2. Description of the Related Art

Assemblies used in manufacturing operations for unrolling wire or strip material coiled on reels have been known and widely used for many years. An illustrative form of one such prior art device is disclosed in U. S. Pat. No. 4,923,138 issued to the present inventor. Such prior art devices often require the reels to placed on their side on a turntable for horizontal uncoiling. Positioning reels in this manner is difficult and can be hazardous to workers as well, due to the extremely high weight [a few hundred pounds, for example, and often much more] of such reels.

Other unreeling devices hold the reel in a vertical position for unreeling about a horizontal axis. When the horizontal axis approach has been used in the past, it generally required lifting the reel above the floor and mounting it on a horizontal spindle which further increases the effort and potential hazards involved. To alleviate some of the effort of lifting and mounting on a central-axis spindle, some prior art devices supported the reel by lifting the reel slightly above the floor and then positioning rollers, mounted a fixed distance apart on a common chassis, under opposite sides of the outer periphery of the reel, so that the rollers both supported the reel and allowed it to rotate. The difficulties inherent in this approach to lifting and supporting a reel include the ongoing difficulty of lifting the reel into position and the mechanical limitations of positioning rollers, mounted a fixed distance from each other, beneath the reel.

SUMMARY OF THE INVENTION

The reel-handling device of this invention comprises an assembly for lifting a reel of cable above the floor and supporting it for easy rotation, using two frame members slidably and pivotably coupled to each other. The first frame has a rotatable stop for engaging the periphery of a reel and the second is pivotally and slidably coupled to the first via a toggle mechanism. The second frame is pivoted out of the way to a first position to permit a cable reel to be rolled along the floor into engagement with the stop member of the first frame and then pivoted back to a second position to capture the reel within a cable reel-receiving channel in the second frame. The receiving channel has an open end near the first frame and a reel-engaging stop member near the opposite closed end of the channel. The toggle mechanism levers the second frame in sliding relation toward the first frame to capture and lift the reel between the stop members of the two frames. The stop members have rotary features and a motor driven assist for at least one of them to aid in rotation of the reel.

DETAILED DESCRIPTION OF THE PREFERRED EMBODIMENT

Figure 1:
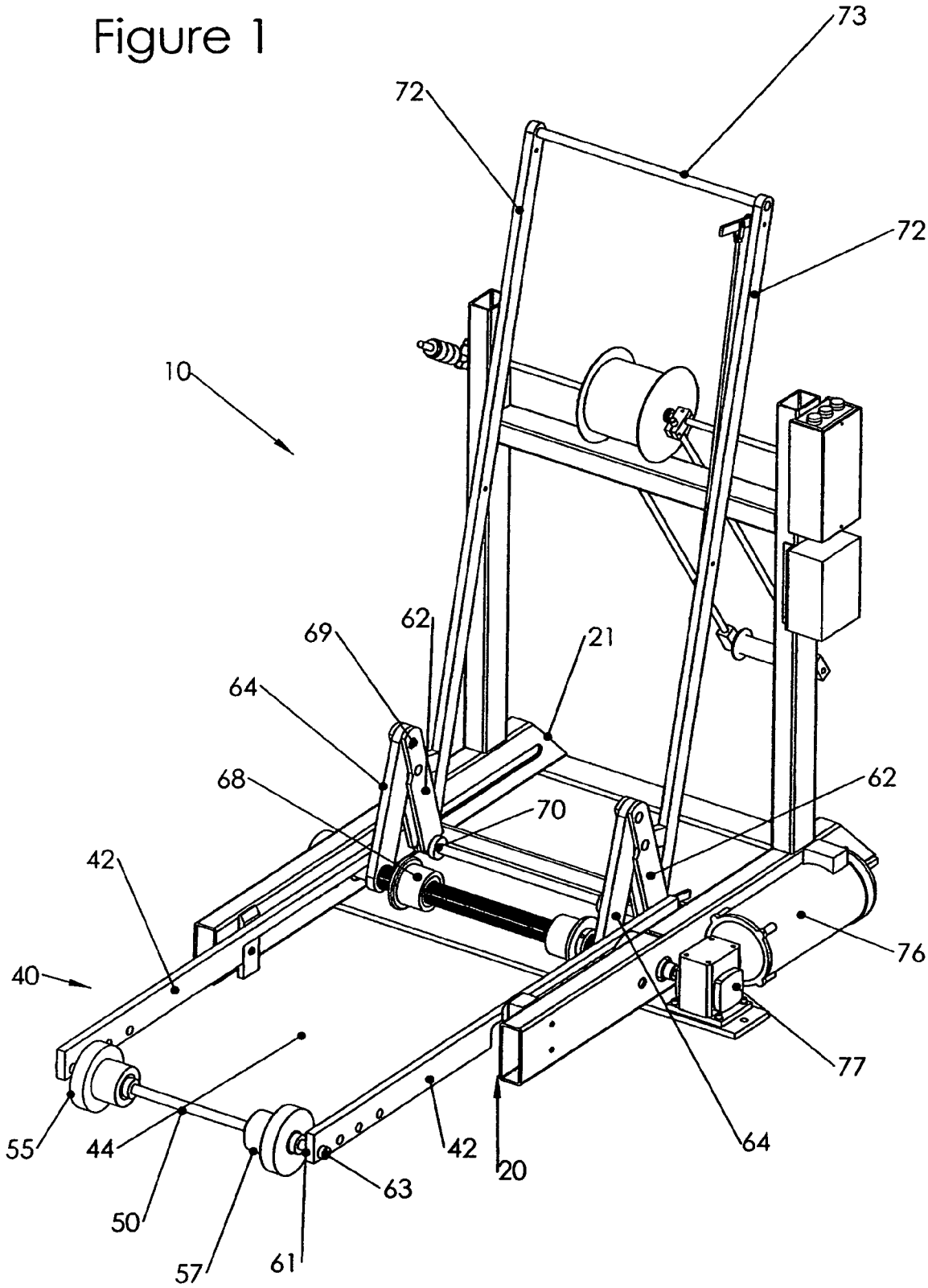
FIG. 1 is an overall perspective view of a lever lift handling assembly in accordance with this invention.

Referring now to FIG. 1 of the drawings, it can be seen that a handling assembly [10] in accordance with this invention comprises a receiving frame member [20], a knuckle mechanism [60] pivotally coupled to the receiving frame member, and a capturing trolley member [40] coupled to move slidably and pivotally relative to the receiving frame member through linkage with the knuckle mechanism.

The receiving frame member [20] has a structural plane [22], positionable generally parallel to the floor [11], and has a cable reel stop member [24], substantially parallel to the structural plane [22] and consequently, to the floor [11], for engaging a cable reel [12] against the cable reel stop member [24]. It can be seen readily that the cable reel [12] can be rolled along the floor [11] into abutting relationship with the cable reel stop member [24]. This can be accomplished when capturing trolley member [40] is pivoted out of the way, that is, up and at an angle to the floor as shown in dotted lines in FIG. 2 and as will be further explained herein.

The knuckle mechanism [60] is pivotally coupled to the receiving frame member [20] in proximity to the cable reel stop member [24]. That is, the knuckle mechanism [60] has a first link member [62], pivotally coupled to the second link member [64] at first pivot axis [69] and it is the second link member [64] that couples the toggle mechanism [60] [i.e. knuckle mechanism] to the receiving frame at a second pivot point [68] which is spaced from pivot point [69]. As shown, pivot axis [68] coincides with the axis of receiving frame cable stop member [24]. Although this construction is shown in this preferred embodiment, alternatively it is satisfactory for second link member [64] to be pivotally coupled to receiving frame member [20] in proximity to cable stop member [24]. In this context, the terms pivot point and pivot axis may be regarded as interchangeable.

Still referring to FIG. 1, the capturing trolley member [40] may be seen to have two outer leg portions [42], a capturing channel [44] which has a pivot end [46], a closed end [48] and a capturing trolley stop member [50]; the capturing channel [44] being substantially defined by outer leg portions [42]. Although capturing trolley stop member [50] is shown herein to coincide with closed end [48], these two elements may in fact be formed separately. It will be obvious to those skilled in the art that, to optimize use of space and material, it is desirable that closed end [48] and stop member [50] be located in proximity to each other remote from pivot end [46]. The ultimate optimization in this regard is for the trolley stop member [50] to coincide with and define closed end [48].

Capturing trolley member [40] is pivotally coupled to the first link member [62] of the knuckle mechanism [60] and, outer leg portions [42] of the trolley are slidably displaceable, in a direction substantially parallel to the floor [11] which is parallel to structural plane [22], in a telescopic manner relative to the receiving frame member [20].

In accordance with this invention, receiving frame [20] comprises a pair of spaced-apart outer rail members [21] mounted to cross bars [23]. Rails [21] are spaced apart to permit capturing trolley member [40] to be slidably/telescopically received between them.

Figure 2:
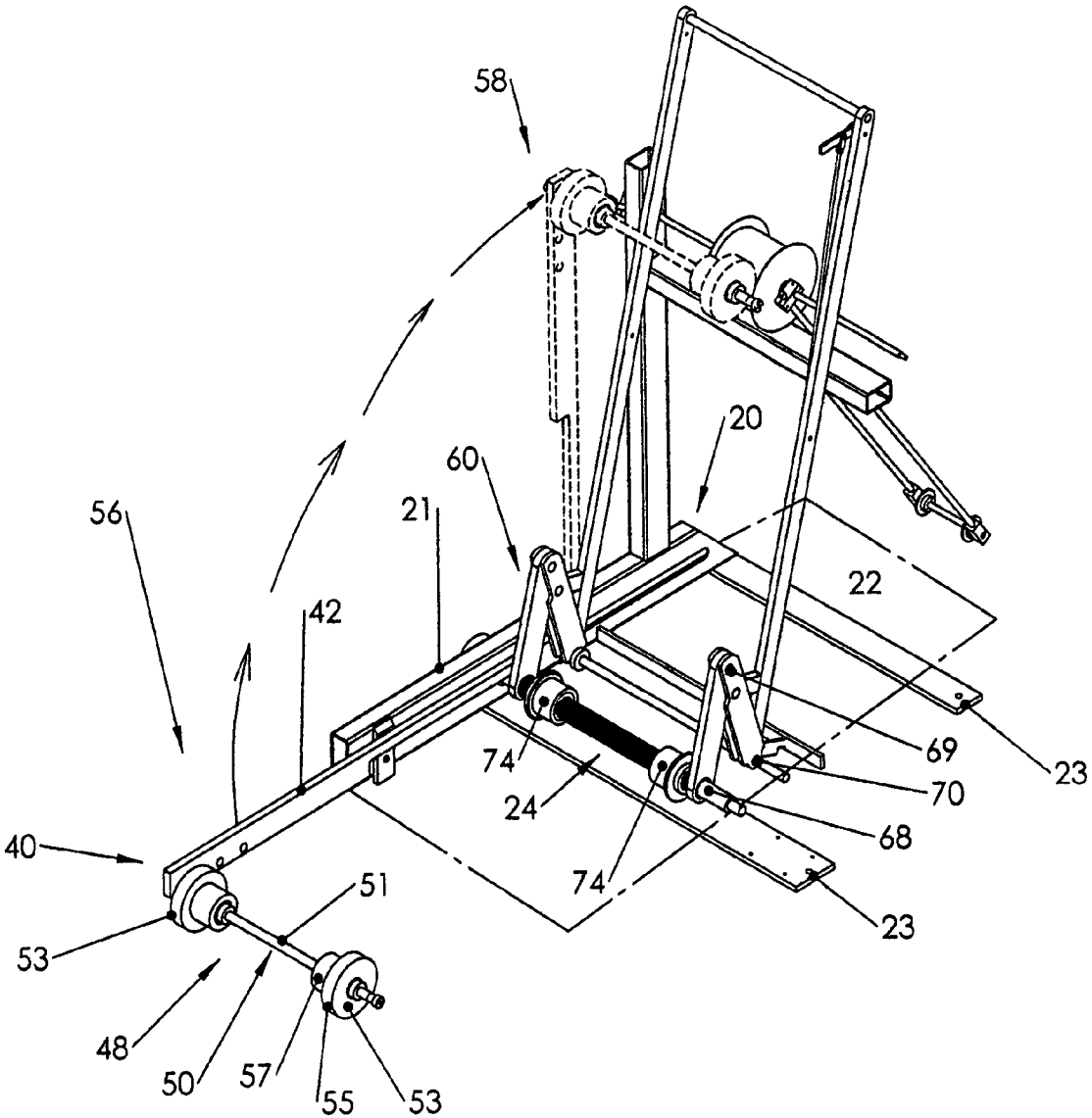
FIG. 2 is a partial perspective view of the lever lift assembly of FIG. 1, showing a displaced position of a movable element.
Figure 3:
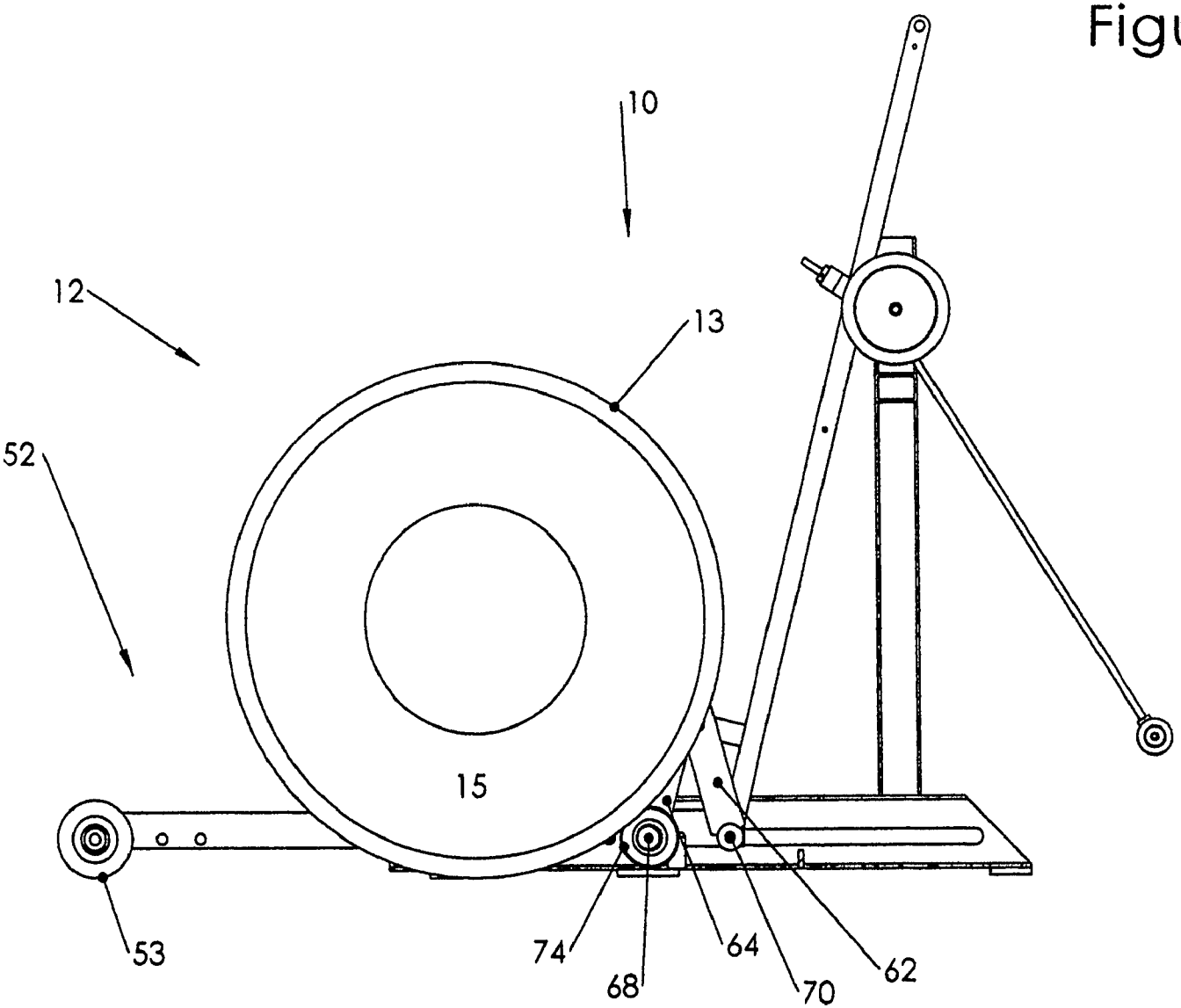
FIG. 3 is a simplified side elevation view of the lever lift assembly of FIG. 1 showing the assembly in a first position ready to fully capture a cable reel.
Figure 4:
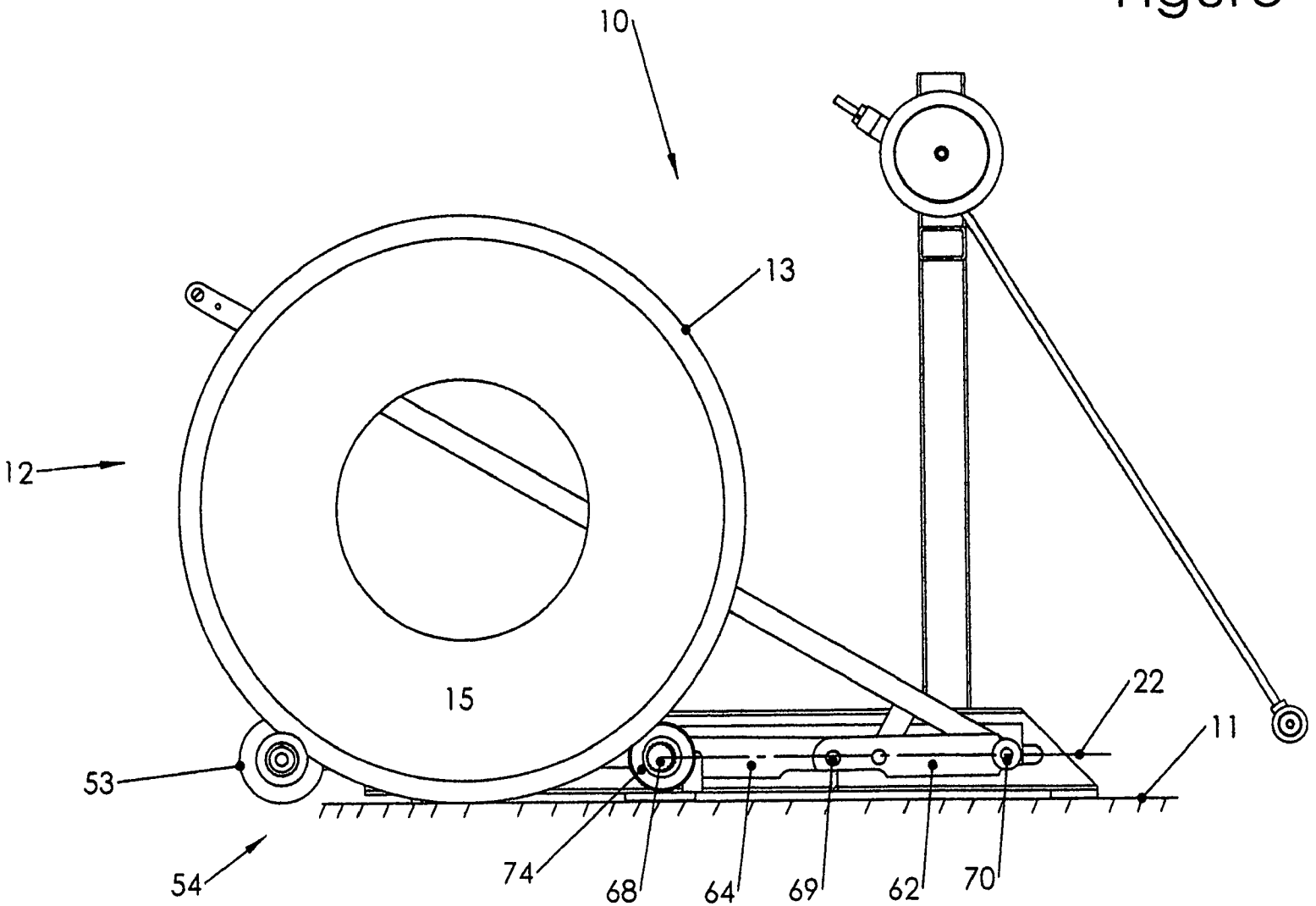
FIG. 4 is a simplified side elevation view of the lever lift assembly of FIG. 3 showing the assembly in a second position with a cable reel fully captured but not yet locked in engagement.

Referring now again to FIG. 2, in which for clarity the reel is not shown, it can be seen that knuckle mechanism [60] is pivotally coupled to receiving frame [20] at pivot axis [68] and pivotally coupled to capturing trolley [40] at third pivot axis [70] so that, as knuckle mechanism [60] is pivotally unfolded about its central pivot axis [69], from the position shown in FIG. 3 to the position shown in FIG. 4, capturing trolley [40] is displaced relative to the receiving frame member [20], from a first, capturing position [52] to a second, captured position [54], in reaction to movement of the knuckle mechanism [60]. It can now be seen that pivot axis [68] remains in a fixed position relative to receiving frame [20], while pivot axis [70] remains in a fixed relationship with capturing trolley [40]. As axis [70] moves [slides along frame 20] relative to axis [68], knuckle mechanism [60] bends and straightens about its central pivot point [69], drawing trolley [40] along with it.

That is, capturing trolley [40] is telescopically displaced relative to receiving frame [20] in reaction to forces generated by displacement of the knuckle mechanism [60]. For this purpose, knuckle mechanism [60] is provided with lever handles [72] to assist in moving both the knuckle mechanism [60] and the capturing trolley [40]. A pair of lever handles [72] coupled to each other by a handle bar [73] is preferred but, as an engineering choice, arrangements can be made to use a single lever handle [72].

An important feature of this invention is the capability of capturing trolley 1 [40] to both slide relative to receiving frame [20] and to pivot relative to the frame. This capacity for two disparate forms of relative motion, pivoting and sliding, allows the trolley [40] to be pivoted up and out of the way of a cable reel [12] into a ready-to-capture position [58] [see FIG. 2] as the reel is rolled along the floor into contact with receiving frame cable stop [24], and to be pivoted down again, parallel to structural plane [22] with a reel [12] captured between the receiving frame cable stop member [24] and the capturing trolley stop member [50]. Subsequently, trolley [40] is slidably displaced by the lever-action of knuckle mechanism [60] to draw the two stop members [24, 50] toward each other until they first engage the diametrically opposite sides of the periphery of a reel [12] and then squeeze that periphery slightly further to lift the reel until it rises above contact with the floor [11].

To assure proper operation with reels of different diameters, the outer leg members [42] of trolley [40] are provided with a plurality of spaced apart apertures [43] that permit the longitudinal position of trolley stop member [50] along capturing channel [44], to be adjusted. That is, stop member [50] comprises an axel shaft [51] with spacer wheels [53] mounted thereon; the shaft [51] having threaded end portions [61] that can be fitted with threaded nuts [63] to hold the shaft against outer leg portions [42] in a well-known manner. By selecting spaced-apart apertures [43] at the desired location along outer leg members [42], the space between trolley stop member [50] and receiving frame stop member [24] can be adjusted to accommodate properly, reels having a wide range of different diameters.

Capturing trolley stop member [50] includes a pair of guide wheels [53] mounted on shaft [51]. The wheels have a stepped configuration with a larger diameter portion [55] and a lesser diameter portion [57] located inward of the larger diameter. This configuration allows the outer periphery of reel [12] to roll along the lesser inner diameter portion [57], while the larger diameter portion [55] engages the outer side edges of the reel [12] to maintain the reel in longitudinal alignment within capturing channel [44]. The larger diameter portion [55] further serves to allow the trolley [40] to roll along floor [11] when the trolley is being slidably displaced relative to receiving frame [20].

Wheels [53] are mounted to rotate freely on shaft [51] which generally remains fixed against rotation by threaded nut fasteners [63] on the ends of the shaft. On the other hand, cable stop member [24] on receiving frame [20] comprises a pair of spaced-apart guide wheels [74] mounted on the splined [75] shaft which is splined so that the inner splines in the guide wheel centers necessarily cause the wheels [74] to rotate with the shaft [75]. As shown most clearly in FIG. 1, shaft [75] is driven by a motor [76] of any suitable type through a gear box [77] to facilitate rotation of a captured reel [12] that is in engagement with the drive wheels [74].

Summarizing the operation of the invention: to receive a reel, lever handles [72] are moved to the position shown in FIG. 3 which folds knuckle mechanism [60] into an acute angle position, as shown in FIGS. 1 and 2, thereby slidably displacing trolley [40] to its extreme forwardly extended first position [52] relative to receiving frame [20]. Trolley [40] is then pivoted upward, about pivot axis [70], into its generally vertical, ready-to-receive position [58], as indicated in FIG. 2, at an angle to structural plane [22]. After a reel [12] has been rolled along floor [11] into engagement with cable reel stop member [24], trolley [40] is pivotally displaced from its upright, ready-to-receive position [58], back into its first captured position generally parallel to structural plane [22] and floor [11]. Then, lever handle [72] is pivoted forwardly and downward about pivot axis [70] from its upright position toward a position forming a generally acute angle with structural plane [22]; this action extends knuckle mechanism [60] from its acute angle position toward an extended, straight angle position which has the effect of slidably/telescopically displacing trolley [40] inwardly into receiving frame [20] and moves trolley stop member [50] closer toward cable stop member [24]. As pointed out previously herein, trolley [40] is moved from its first, capturing position [52] to its second, captured position [54], in this step.

It will be obvious to those having skill in the art that the important value for the distance between the two stop members [24, 50] is the value that serves to constrict the outer arc of the reel [12] sufficiently to lift it from the floor. In accordance with this invention this distance occurs when trolley [40] is in its second, captured position [54] with knuckle mechanism [60] in the over center, locked position shown in FIG. 5.

Figure 5:
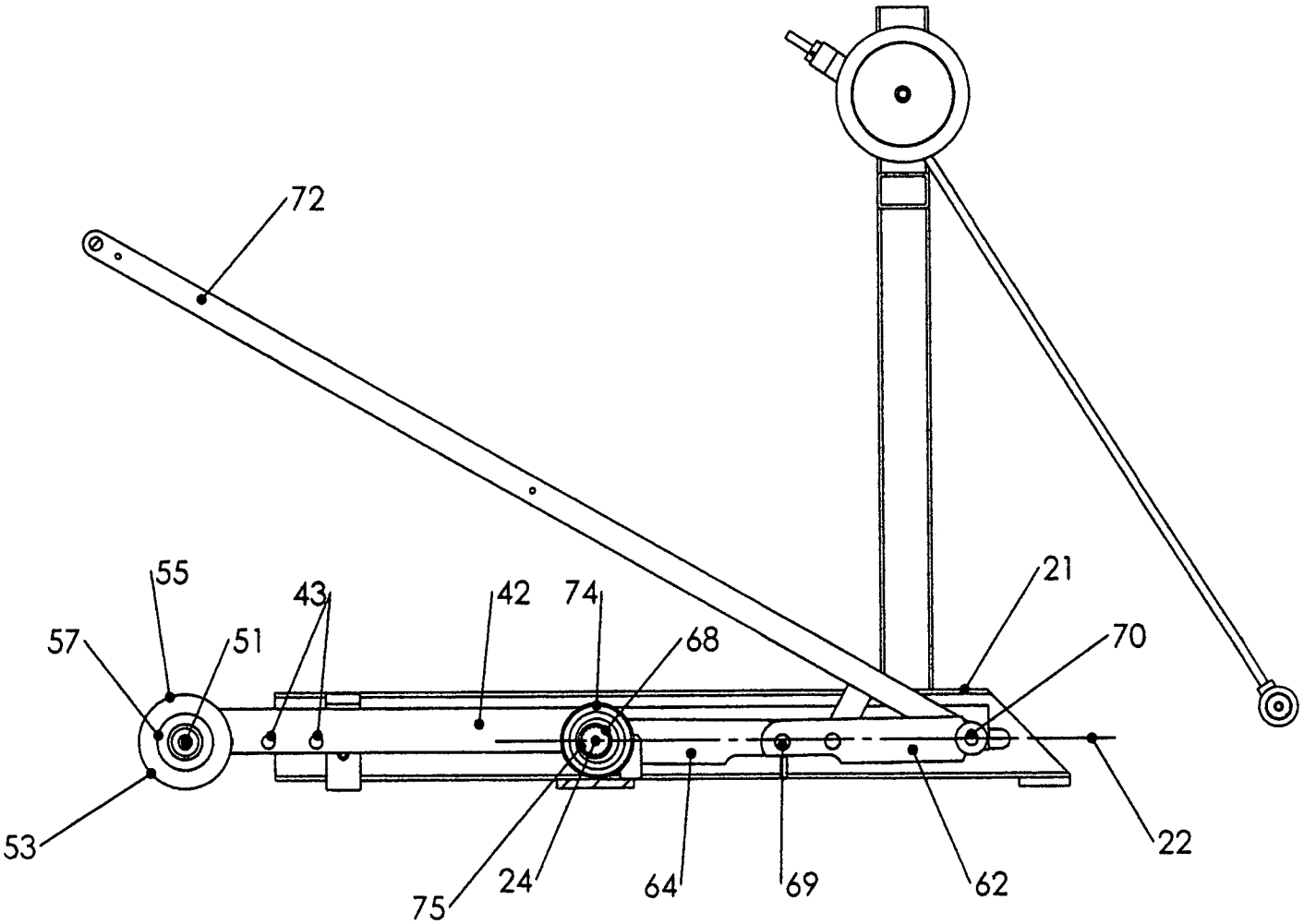
FIG. 5 is a simplified side elevation view of the lever lift assembly of FIG. 4 showing the assembly in a final, locked position.

At this point it should be noted that knuckle mechanism [60] employs an over-the-center locking function of well-known design to maintain a reel [12] in lifted-above-the-floor position. As shown in FIG. 5, as lever handle [72] displaces knuckle mechanism [60] from the position shown in FIG. 3 to the final position shown in FIG. 5, central pivot point [69] of the knuckle mechanism [60] crosses structural plane [22] from the top side to the bottom side, and becomes locked against further displacement in a manner well-understood by those having skill in the art. Knuckle mechanism [60] can be released only by lifting lever handle [72] up toward vertical orientation, thereby displacing pivot axis [69] out of locking relationship above structural plane [22] where the knuckle mechanism can again fold about central pivot axis [69].

Although a preferred embodiment of the invention has been illustrated and described, it will be obvious to those having skill in this art that various other forms and embodiments of the invention now may be visualized readily, by those having skill in this art, without departing substantially from the spirit and scope of the invention set forth herein and described in the accompanying claims.

The invention claimed is:

1. A handling assembly [10] for lifting from the floor [11], and facilitating rotation of a circular cable reel [12], said assembly comprising:

a receiving frame member [20] having a structural plane [22], positionable generally parallel to said floor [11], and having a cable reel stop member [24] substantially parallel to said structural plane for engaging the outer periphery [13] of said cable reel [12];

a knuckle mechanism [60] having a first link member [62], and a second link member [64] pivotally coupled to said first link member at a first pivot axis [69], said second link member further being pivotally coupled at a second pivot axis [68] to said receiving frame member [20] proximate said cable reel stop member [24];

a capturing trolley member [40] having a capturing channel [44], a pair of outer leg portions [42] defining said capturing channel between them, a pivot end [46] and a closed end [48], and having a capturing trolley stop member [50] proximate said closed end [48], said capturing trolley member [40] being pivotally coupled to said first link member at a third pivot axis [70] and being slidably displaceable relative to said receiving frame member [20] along said outer leg portions substantially parallel to said structural plane;

said knuckle mechanism having a lever handle [72] for actuating said knuckle mechanism to slidably displace said capturing trolley between a first position [52] and a second position [54];

said capturing trolley member [40] in said first position being pivotable relative to said receiving frame member [20] between a first captured-position [56] substantially parallel to said structural plane of said receiving frame member, and a ready-to-receive position [58] disposed at an angle to said captured position, wherein said cable reel [12] is rollable along said floor into engagement against said cable reel stop member [24], and said capturing trolley member [40] is pivotable over said cable reel [12] from said ready-to-receive position [58] to said first captured-position [56] with said cable reel [12] within said capturing channel;

said capturing trolley member [40] in said ready-to-receive position [58] being slidably displaceable relative to said receiving frame member [20] from said first position, wherein said capturing trolley stop member [50] is remote from said cable reel stop member [24], to said second position wherein said capturing trolley stop member [50] stop member is sufficiently close to said cable reel stop member [24] to compress the periphery of said cable reel against said cable reel stop member and elevate said cable reel above said floor.

2. A handling assembly [10] in accordance with claim 1 wherein:

said cable reel stop member [24] and said capturing trolley stop member [53] comprise rotatable elements to facilitate rotation of said cable reel.

3. A handling assembly [10] in accordance with claim 2 further comprising:

a motor assembly [76] coupled to selectively rotate said cable reel stop member [24] of said receiving frame member [20] for rotation of said cable reel.

4. A handling assembly [10] in accordance with claim 3 wherein:

said cable trolley stop member [50] defines said closed end.

5. A handling assembly [10] in accordance with claim 1 wherein:

said cable reel stop member has a pair of guide wheel members [53] mounted thereon for engaging the outer surfaces [15] of said cable reel [12] to help maintain said reel within the confines of said cable reel capturing channel.

6. A handling assembly [10] in accordance with claim 5 wherein:

said capturing trolley guide wheel members [53] include larger diameter portions [57] that roll along said floor to facilitate slidable displacement of said capturing trolley member along said floor.

7. A handling assembly [10] in accordance with claim 6 wherein:

said capturing trolley guide wheel members [53] comprise said larger diameter portions [55] and lesser diameter portions [57] disposed inwardly of said larger diameter portions for engaging said outer periphery of said cable reel.

8. A handling assembly [10] in accordance with claim 1 wherein:

said knuckle mechanism comprises a pair of substantially similar knuckle mechanisms disposed on opposite sides of said capturing channel.

9. A handling assembly [10] in accordance with claim 1 wherein:

the length of said outer leg members between said third pivot axis [70] and said capturing trolley stop member [50] is not less than the outer diameter of said cable reel [12].

10. A handling assembly [10] in accordance with claim 1 wherein:

said outer leg members [42] of said capturing trolley member [40] each has a plurality of aligned, spaced-apart apertures [43] therein for selectively receiving said trolley stop member [50] at different positions along the length of said capturing channel.

* * * * *